US011470691B2

(12) United States Patent
Li

(10) Patent No.: US 11,470,691 B2
(45) Date of Patent: Oct. 11, 2022

(54) ATOMIZING ASSEMBLIES AND ELECTRONIC ATOMIZING DEVICES HAVING THE SAME

(71) Applicant: SHENZHEN SMOORE TECHNOLOGY LIMITED, Shenzhen (CN)

(72) Inventor: Xiaoping Li, Shenzhen (CN)

(73) Assignee: shenzhen smoore technology limited, Shenzhen (CN)

( * ) Notice: Subject to any disclaimer, the term of this patent is extended or adjusted under 35 U.S.C. 154(b) by 402 days.

(21) Appl. No.: 16/686,729

(22) Filed: Nov. 18, 2019

(65) Prior Publication Data

US 2020/0187568 A1 Jun. 18, 2020

(30) Foreign Application Priority Data

Nov. 19, 2018 (CN) ..... 201821904455.6

(51) Int. Cl.
*H05B 3/46* (2006.01)
*H05B 3/03* (2006.01)

(52) U.S. Cl.
CPC ..... *H05B 3/46* (2013.01); *H05B 3/03* (2013.01); *H05B 2203/021* (2013.01)

(58) Field of Classification Search
CPC ..... H05B 3/46; H05B 3/03; H05B 2203/021; A24F 40/485; A24F 40/10; A24F 40/44; A61M 15/06
See application file for complete search history.

(56) References Cited

U.S. PATENT DOCUMENTS 10,004,274 B2 * 6/2018 Li ..... A61M 11/042
2014/0360514 A1 * 12/2014 Zhu ..... A24F 40/42 131/329
2018/0199631 A1 * 7/2018 Chen ..... A61M 15/06

FOREIGN PATENT DOCUMENTS

CN 203353676 U 12/2013
CN 204091015 U 1/2015
CN 104582513 A 4/2015
(Continued)

OTHER PUBLICATIONS

European Search Report for European Application No. 19210004.8 dated Mar. 12, 2020.
(Continued)

*Primary Examiner* — Tho D Ta
(74) *Attorney, Agent, or Firm* — Dorsey & Whitney LLP

(57) ABSTRACT

An atomizing assembly includes a housing, an atomizing base, an atomizing element, and a sealing member. The housing is provided with a liquid storage chamber and an airflow channel. The liquid storage chamber is configured to store liquid. The atomizing base is fixed to the housing and configured to seal the liquid storage chamber. The atomizing base is provided with a liquid inlet in communication with the liquid storage chamber. The atomizing element is disposed in the atomizing base and configured to atomize the liquid flowing into the atomizing element through the liquid inlet. The sealing member is movably disposed on the atomizing base and configured to seal or unseal the liquid inlet. An electronic atomizing device is further provided, which includes the aforementioned atomizing assembly and a power supply assembly connected to the housing and electrically coupled to the atomizing element.

18 Claims, 11 Drawing Sheets

(56) References Cited

FOREIGN PATENT DOCUMENTS

| | | | | | | |
|---|---|---|---|---|---|---|
| CN | 204393352 | U | | 6/2015 | | |
| CN | 204444261 | U | | 7/2015 | | |
| CN | 105192895 | A | | 12/2015 | | |
| CN | 105661650 | A | | 6/2016 | | |
| CN | 105962420 | A | | 9/2016 | | |
| CN | 106037011 | A | | 10/2016 | | |
| CN | 205695704 | U | | 11/2016 | | |
| CN | 107156918 | A | | 9/2017 | | |
| CN | 206949544 | U | | 2/2018 | | |
| CN | 207821092 | U | | 9/2018 | | |
| CN | 109152416 | A | * | 1/2019 | ..... | A24F 40/42 |
| WO | WO-2018219949 | A1 | * | 12/2018 | ..... | A24F 40/40 |

OTHER PUBLICATIONS

Office Action for Chinese Application No. 201811377134.X dated Oct. 27, 2020.
Office Action for Chinese Application No. 201811378533.8 dated May 12, 2021.
Office Action for Chinese Application No. 201811378533.8 dated Oct. 27, 2020.

* cited by examiner

ATOMIZING ASSEMBLIES AND ELECTRONIC ATOMIZING DEVICES HAVING THE SAME

CROSS REFERENCE TO RELATED APPLICATION

This application claims priority to Chinese Patent Application No. 2018219044556, entitled "ELECTRONIC ATOMIZING DEVICE AND ATOMIZING ASSEMBLY THEREOF" filed on Nov. 19, 2018, the contents of which are expressly incorporated herein, in their entirety, by this reference.

TECHNICAL FIELD

The present disclosure relates to atomizing assemblies and electronic atomizing devices having the same.

BACKGROUND

At present, the liquid in the cotton-free atomizing element on the market is usually stored in a sealed liquid storage chamber. During use, the liquid in the liquid storage chamber is absorbed to a heating wire by the capillary force generated by the capillary structure of a liquid guiding member for heating and atomization. Before use, the liquid guiding member is also used to seal and block the liquid to prevent the liquid from overflowing.

However, the way of blocking the liquid by the liquid guiding member is not reliable. Especially during transportation of the atomizing element, due to shocks or other reasons, the liquid guiding member cannot effectively block the liquid, resulting in liquid leakage and affecting the user experience.

SUMMARY

According to various embodiments of the present disclosure, an atomizing assembly and an electronic atomizing device having the same are provided.

An atomizing assembly includes a housing, an atomizing base, an atomizing element, and a sealing member. The housing is provided with a liquid storage chamber and an airflow channel. The liquid storage chamber is configured to store liquid. The atomizing base is fixed to the housing and configured to seal the liquid storage chamber, and the atomizing base is provided with a liquid inlet in communication with the liquid storage chamber. The atomizing element is disposed in the atomizing base and configured to atomize the liquid flowing into the atomizing element through the liquid inlet. The sealing member is movably disposed on the atomizing base and configured to seal or unseal the liquid inlet.

An electronic atomizing device includes the aforementioned atomizing assembly and a power supply assembly. The power supply assembly is connected to the housing and electrically coupled to the atomizing element.

The above and other features of the disclosure including various novel details of construction and combinations of parts, and other advantages, will now be more particularly described with reference to the accompanying drawings and pointed out in the claims.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

Figure 1:
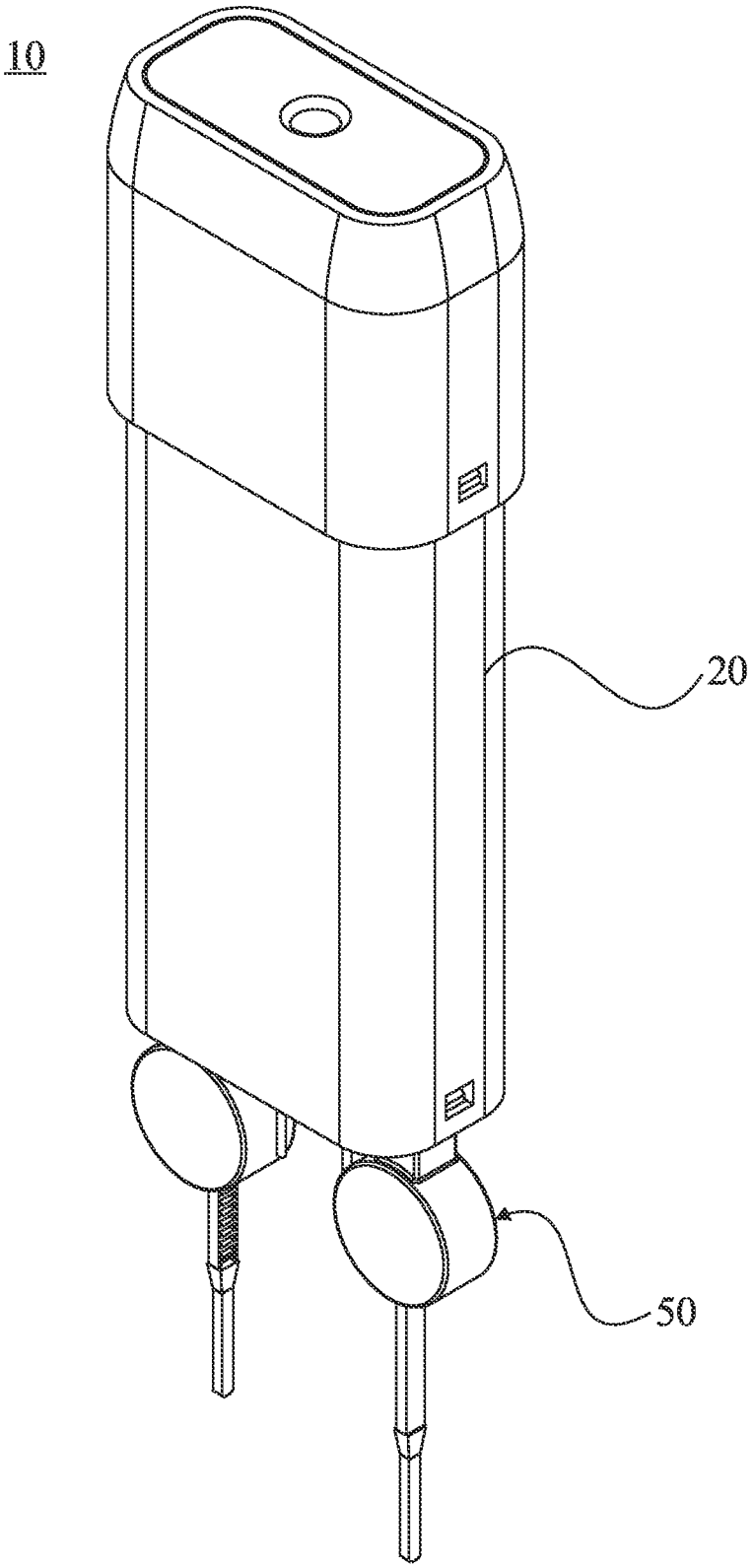
FIG. 1 is a schematic view of an atomizing assembly according to an embodiment.

Embodiments of the disclosure are described more fully hereinafter with reference to the accompanying drawings. The various embodiments of the disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Elements that are identified using the same or similar reference characters refer to the same or similar elements.

It will be understood that when an element is referred to as being "fixed" to another element, it can be directly fixed on the other element or intervening elements may be present. When an element is referred to as being "connected" or "coupled" to another element, it can be directly connected or coupled to the other element or intervening elements may be present. The terms used herein "vertical", "horizontal", "left", "right", and the like are for illustrative purposes only and are not intended to be the only implementation.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
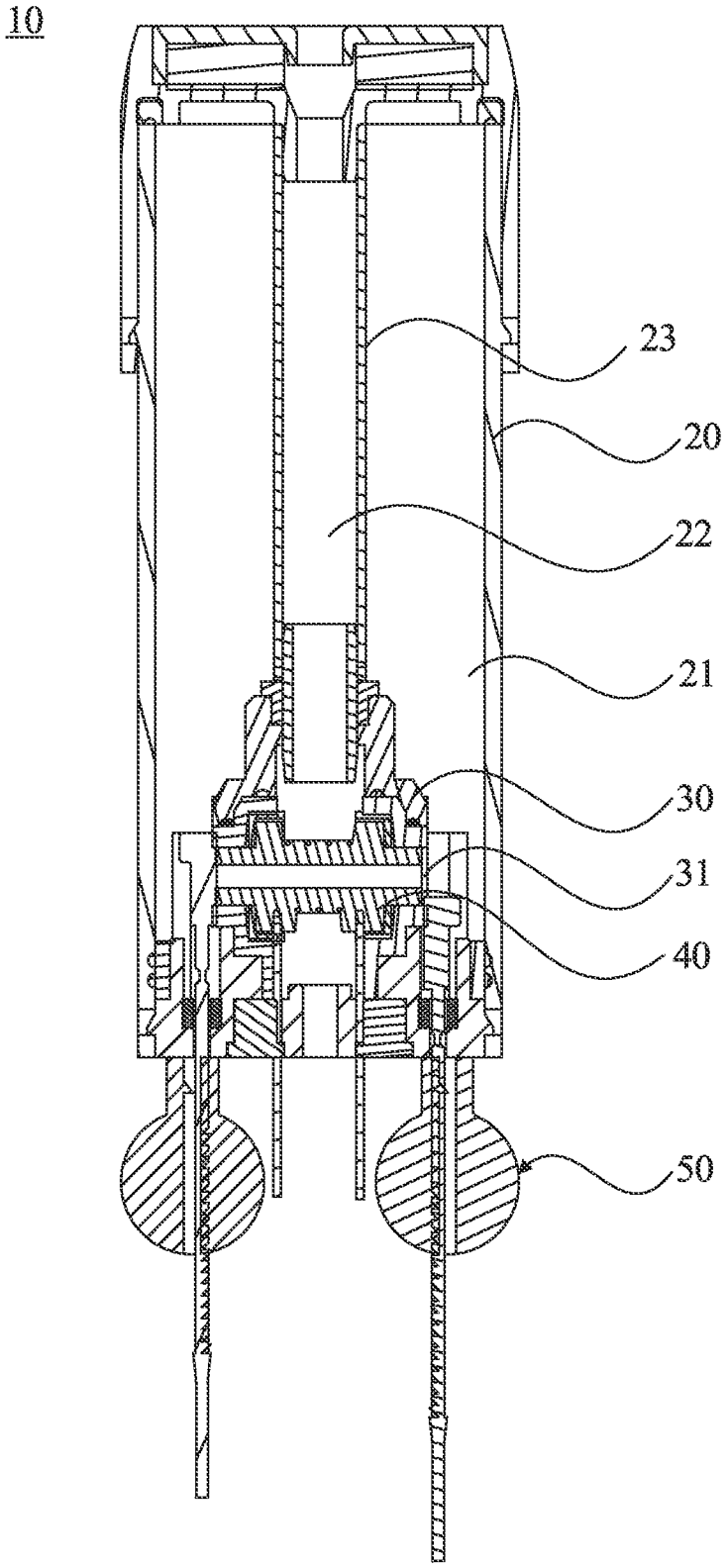
FIG. 2 is a cross-sectional view of the atomizing assembly of FIG. 1.

Referring to FIGS. 1 and 2, an atomizing assembly 10 in accordance with an embodiment includes a housing 20, an atomizing base 30, an atomizing element 40, and a sealing member 50. The housing 20 is provided with a liquid storage chamber 21 configured to store liquid therein. The housing 20 is further provided with an airflow channel 22 therethrough. The airflow channel 22 is formed by a breather pipe 23 located within the housing 20, and extends through the breather pipe 23 in an axial direction thereof. The atomizing base 30 is fixed to the housing 20 and seals the liquid storage chamber 21. The atomizing base 30 is provided with a liquid inlet 31 in communication with the liquid storage chamber 21. The atomizing element 40 is disposed in the atomizing base 30. The liquid in the liquid storage chamber 21 can flow into the atomizing element 40 through the liquid inlet 31, and the external airflow can flow into the airflow channel 22 through the atomizing element 40. The atomizing element 40 atomizes the liquid to form smoke, which can flow into the airflow channel 22 with the external airflow, and be output from the airflow channel 22 and sucked by the user. The sealing member 50 is movably disposed on the atomizing base 30, and is configured to seal or unseal the liquid inlet 31.

The sealing member 50 moves relative to the atomizing base 30 to seal the liquid inlet 31, thereby preventing the atomizing assembly 10 from leaking during storage and transportation. In use, the sealing member 50 moves relative to the atomizing base 30 to unseal the liquid inlet 31, and the liquid in the liquid storage chamber 21 flows into the atomizing element 40 through the liquid inlet 31 and is atomized by the atomizing element 40 to form smoke which then flows out through the airflow channel 22. The liquid in the liquid storage chamber 21 may be tobacco oil or other liquid, or may be selected as needed.

Figure 3:
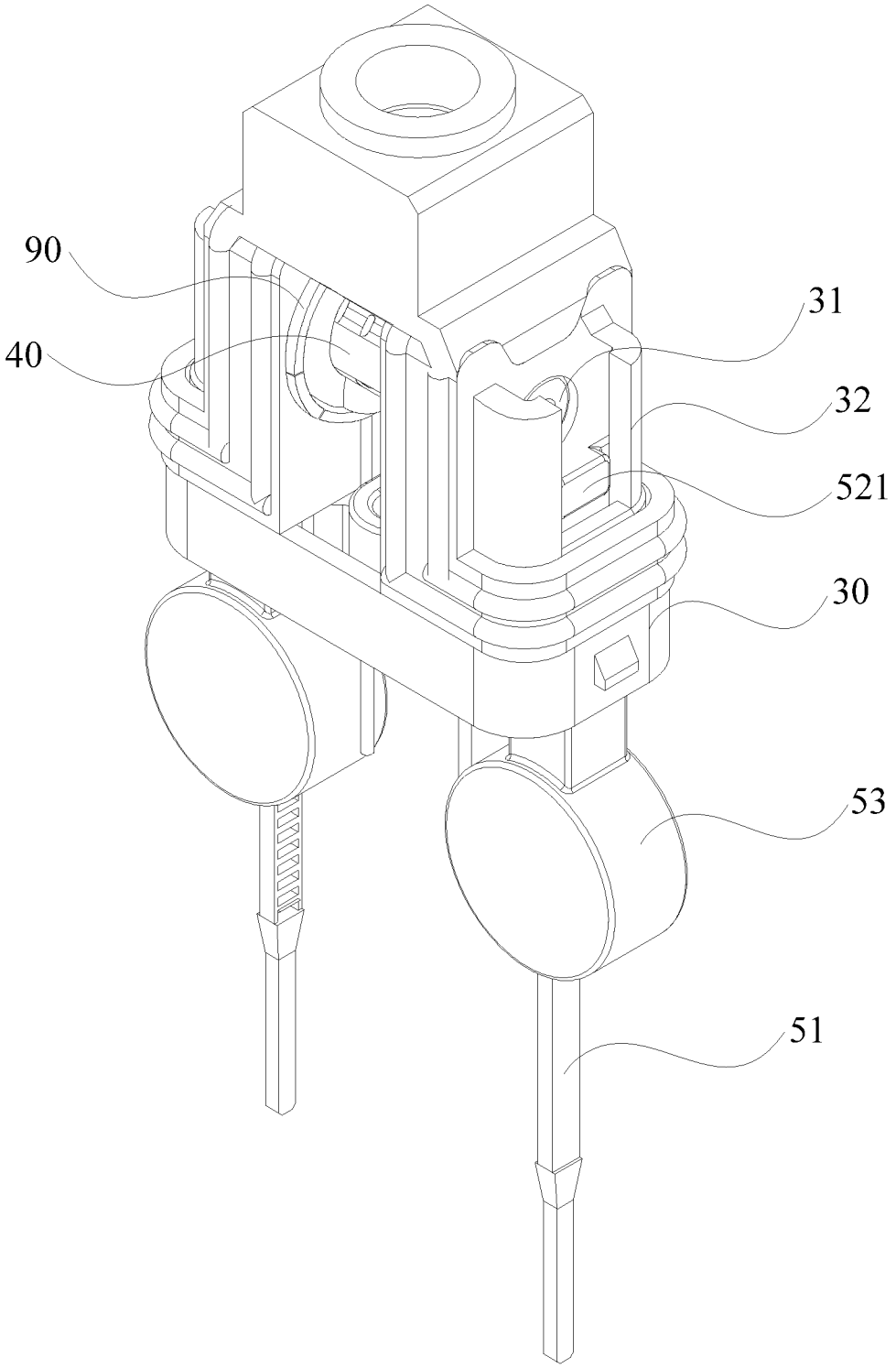
FIG. 3 is a schematic view of an atomizing base, an atomizing element, and a sealing member cooperating with each other of the atomizing assembly of FIG. 1.
Figure 4:
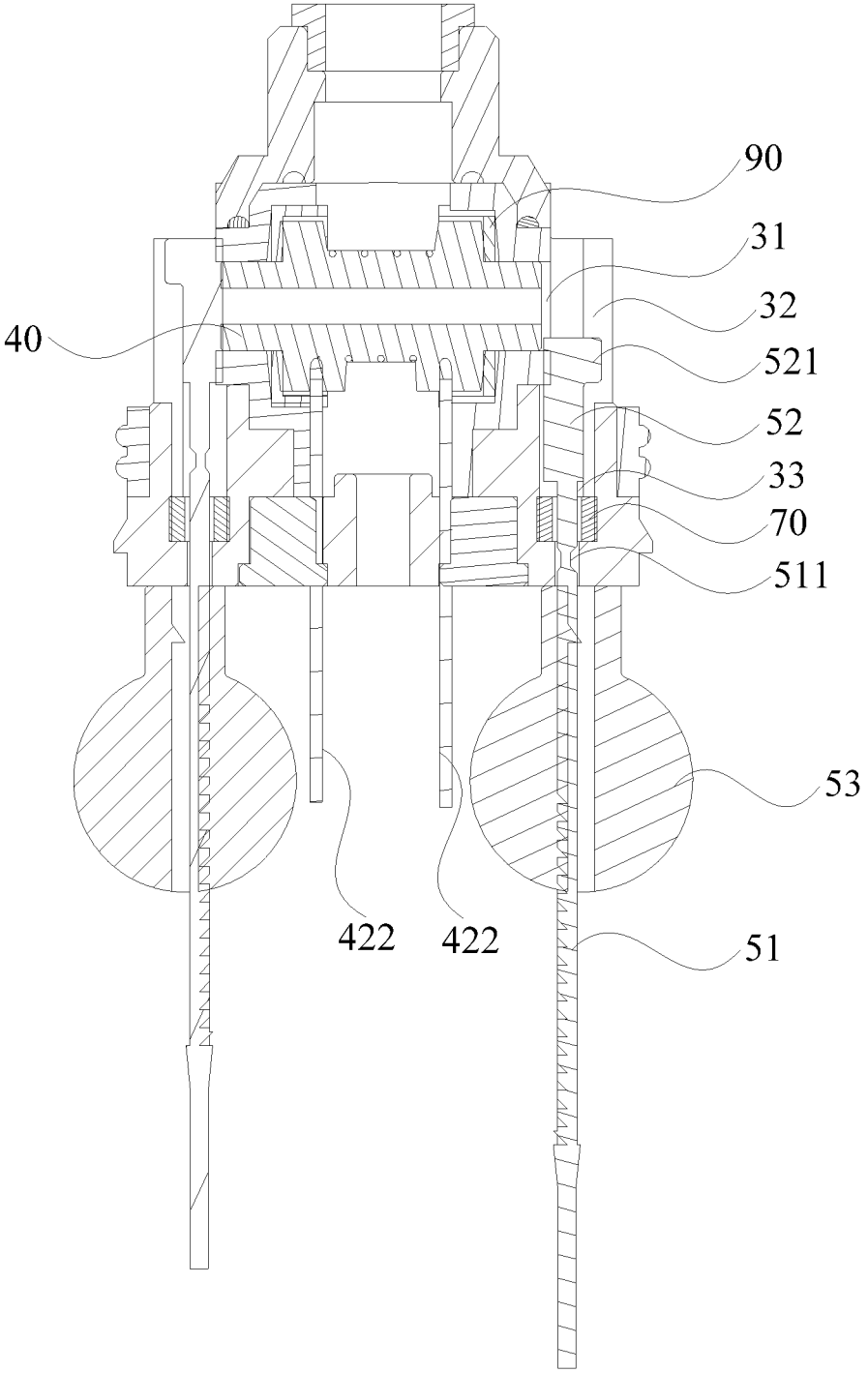
FIG. 4 is a cross-sectional view of the atomizing assembly of FIG. 3.

Referring to FIGS. 3 and 4, to facilitate a smooth moving of the sealing member 50 relative to the atomizing base 30, the atomizing base 30 is provided with a sliding slot 32, and the liquid inlet 31 is located at a bottom of the sliding slot 32. The sealing member 50 is slidably disposed within the sliding slot 32 to seal or unseal the liquid inlet 31. It should be understood that both sides of the atomizing base 30 each may be provided with a liquid inlet 31 in communication with the liquid storage chamber 21, and two sealing members 50 are provided and movably disposed through the atomizing seat 30, and the sealing members 50 and the liquid inlets 31 are disposed in one-to-one correspondence.

In an embodiment, the sealing member 50 includes a pull rod 51 and a sealing portion 52. The pull rod 51 is disposed through the atomizing base 30, and has a first end connected to the sealing portion 52 and a second end extending out of the atomizing base 30. The sealing portion 52 is located within the sliding slot 32. The pull rod 51 moves towards or away from the liquid inlet 31, such that the sealing portion 52 is moved within the sliding slot 32 to seal or unseal the liquid inlet 31. It is possible to move the sealing portion 52 to seal or unseal the liquid inlet 31 by directly pushing or pulling the pull rod 51, such that a more convenient operation and a more applicable configuration are achieved.

The sealing portion 52 is provided with a limiting portion 521 protruding from a side thereof away from the liquid inlet 31. The pull rod 51 is limited by the limiting portion 521 abutting against the atomizing base 30 when the pull rod 51 moves away from the liquid inlet 31. With the limiting portion 521, the sealing portion 52 can be effectively prevented from being moved out of the atomizing base 30.

Before use, the sealing member 50 seals the liquid inlet 31 to prevent liquid in the liquid storage chamber 21 from leaking through the liquid inlet 31 to the atomizing element 40. In use, the sealing member 50 moves the sealing portion 52 away from the liquid inlet 31 to unseal the liquid inlet 31, allowing the liquid in the liquid storage chamber 21 to flow the atomizing element 40 through the liquid inlet 31.

Moreover, a portion of the pull rod 51 extending beyond the atomizing base 30 needs to be removed before the atomizing assembly 10 is assembled with a power supply assembly 60 which is electrically coupled to the atomizing element 40. For this purpose, the pull rod 51 is further provided with a breakage portion 511 having a cross-sectional area less than that of other portions of the pull rod 51. When the atomizing assembly 10 is assembled with the power supply assembly 60, the pull rod 51 can be broken off at the breakage portion 511, such that the portion of the pull rod 51 extending beyond the atomizing base 30 can be removed, and the rest portion of the pull rod 51 is reserved within the atomizing base 30. Thus it is avoided that the portion of the pulling rod 51 extending out of the atomizing base 30 affects the use of the atomizing assembly 10. In an embodiment, the pulling rod 51 may be broken off by pulling the pulling rod 51 towards the outside of the atomizing base 30. In addition, a pull tab 53 is fixedly sleeved on the second end of the pull rod 51 in order to facilitate pushing and pulling the pull rod 51.

It is considered that liquid leakage is likely to occur since there is a clearance presented between the pull rod 51 and the atomizing base 30 due to the sliding engagement therebetween. Therefore, the atomizing base 30 is provided with a sliding channel 33 therethrough and in communication with the sliding slot 32, and an elastic sealing member 70 is latched with the sliding channel 33. The pull rod 51 is disposed through the elastic sealing member 70, and moves within the sliding channel 33 towards or away from the liquid inlet 31. The elastic sealing member 70 may be made of silicone, rubber, plastic or the like. In an embodiment, the sealing portion 52 has a plate shape with a cross-sectional area larger than that of the pull rod 51. A portion of the sliding channel 33 proximal to the liquid inlet 31 has a relatively larger width to adapt to the sliding engagement between the sealing portion 52 and the atomizing base 30. A portion of the sliding channel 33 distal to the liquid inlet 31 has a relatively smaller width to adapt to the sliding engagement between the pull rod 52 and the atomizing base 30. The elastic sealing member 70 is latched with the portion of the sliding channel 33 having the relatively larger width, and abuts against an end of the portion of the sliding channel 33 having the relatively smaller width.

Figure 5:
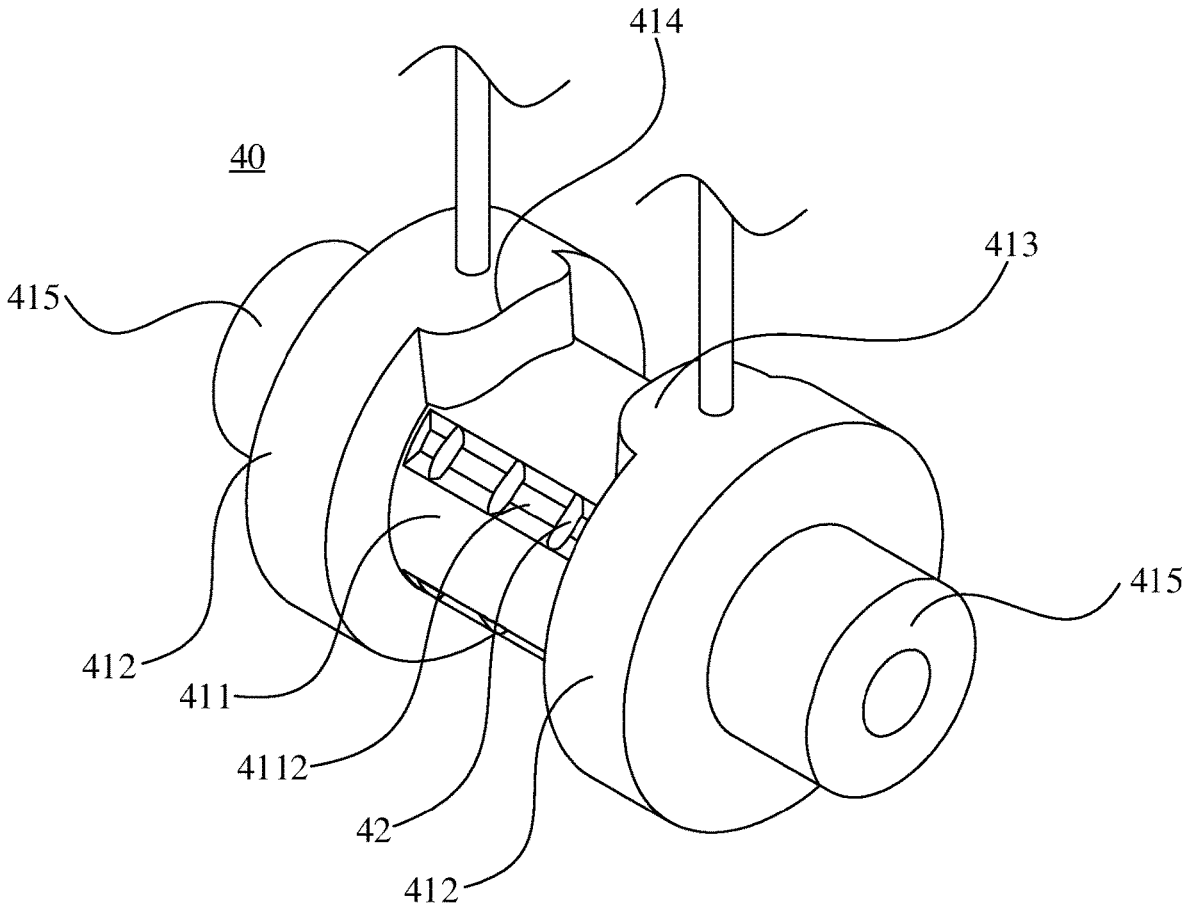
FIG. 5 is a schematic view of the atomizing element of the atomizing assembly of FIG. 1.
Figure 6:
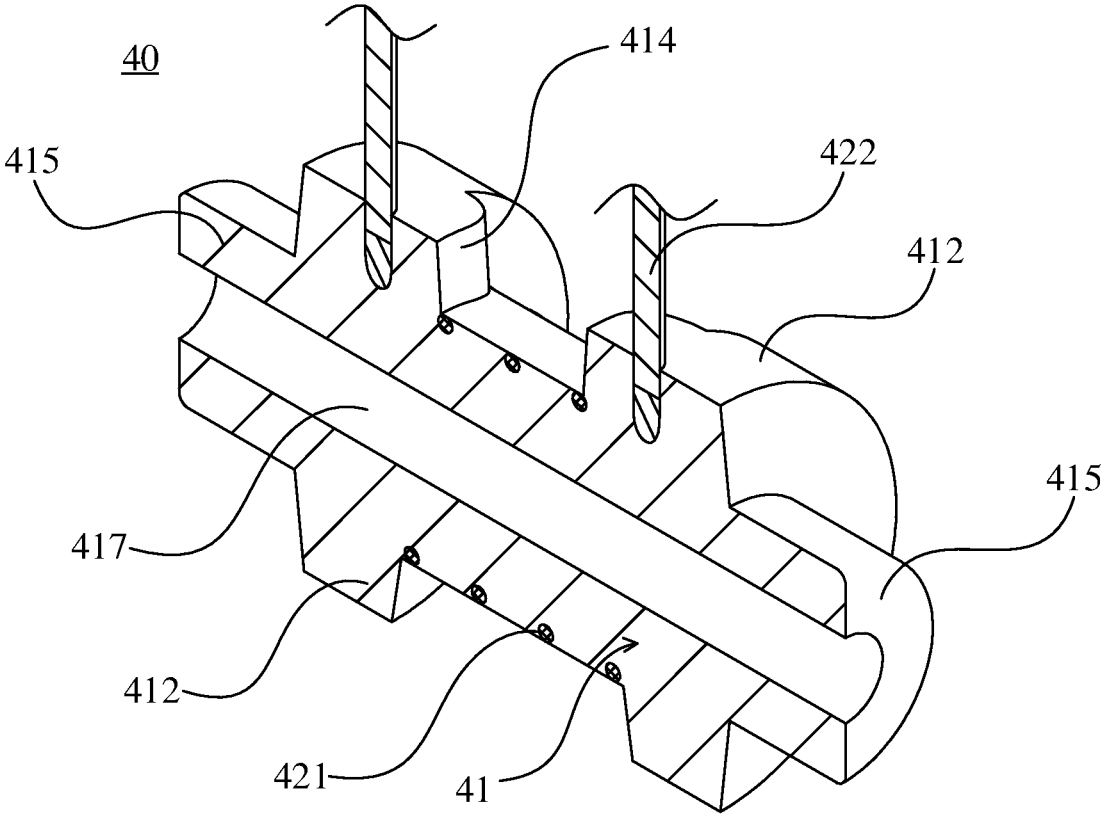
FIG. 6 is a perspective cross-sectional view of the atomizing element of FIG. 5.

In an embodiment, referring to FIGS. 5 and 6, the atomizing element 40 includes a liquid guiding member 41 and a heating element 42. The liquid guiding member 41 is configured to absorb and store the liquid flowing through the liquid inlet 31, and includes a body 411 and a flange 412. The body 411 has an atomizing surface on which the flange 412 is sleeved. The heating element 42 is disposed on the body 411, and has at least one end extending out of the flange 412. In a conventional atomizing assembly, it is found that the heating element is disposed directly on the outer surface of the liquid guiding member and thus would be easily separated from the outer surface of the liquid guiding member when being drawn by an external force, and the separated portion of the heating element is heated without liquid, resulting in an unsatisfactory atomization effect. In contrast, the flange 412 in the present embodiment can firmly fix the end of the heating element 42, such that the heating element 42 can be more firmly disposed on the liquid guiding member 41 and is prevented from being pulled out from the outer surface of the liquid guiding member 41. Thus the heating element 42 can fully heat and atomize the liquid in the liquid guiding member 41 to achieve a better atomization effect. In addition, the end of the heating element 42 would not be separated from the liquid guiding member 41, and thus the heating element 42 is prevented from being heated without liquid to affect the atomization effect.

Figure 7:
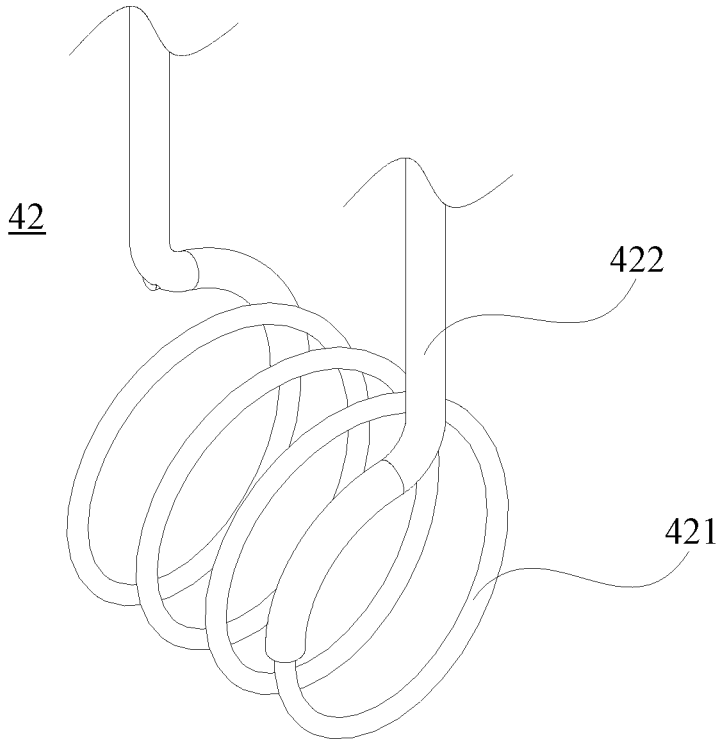
FIG. 7 is a schematic view of a heating element of the atomizing assembly of FIG. 1.

In an embodiment, the body 411 is provided with two flanges 412. Both ends of the heating element 42 extend through the corresponding flanges 412, respectively, and thus are firmly connected to the liquid guiding member 41 without being detached. Referring to FIGS. 5 and 7, the body 411 has a cylindrical shape, an outer peripheral surface of the body 411 is the atomizing surface, and the flanges 412 are provided on the outer peripheral surface of the body 411. The heating element 42 includes a heating wire 421 wound around and bonded to the body 411, and both ends of the heating wire 421 extend through the corresponding flanges 412, respectively. It should be understood that the body 411 may have other shapes. In an embodiment, the body 411 has a flat surface which is the atomizing surface and on which the flanges 412 are disposed, and the heating wire 421 has a disc shape. After the heating wire 421 is disposed on the body 411, the both ends of the heating wire 421 extend through the corresponding flanges 412, respectively. The heating element 42 further includes two conducting wires 422 connecting to the both ends of the heating wire 421 and extending through the flanges 412.

On the basis of the aforementioned embodiment, the conducting wires 422 may extend perpendicularly to an axial direction of the body 411 to reduce the difficulty for setting the conducting wires 422. In an embodiment, a first lead portion 413 and a second lead portion 414 are formed at opposite ends of the two flanges 412, respectively. The conducting wires 422 extend through the junctions of the first lead portion 413 and the second lead portion 414 with the corresponding flanges 412, respectively. With the first lead portion 413 and the second lead portion 414, a fixed portion of the conducting wires 422 becomes larger, so as to firmly fix the conducting wires 422. It should be understood that the first lead portion 413 and the second lead portion 414 may be connected to the atomizing surface of the body 411, or may be spaced apart from the atomizing surface of the body 411. The first lead portion 413 and the second lead portion 414 are protrusions extending toward each other on opposite end faces of the two flanges 412. The cross-sectional shapes of the first lead portion 413 and the second lead portion 414 may be square, semi-circular, trapezoidal, or the like.

It is possible that the conducting wire 422 extends through junction between the first lead portion 413 and the flange 412, that is, the conducting wire 422 has a portion located in the flange 412 and the other portion located in the first lead portion 413. It is also possible that the conducting wire 422 is entirely located within the flange 412, with a radially outer peripheral surface of the conducting wire 422 being internally tangent to an end face of the flange 412 facing the other flange 412. It is also possible that the conducting wire 422 is entirely located within the first lead portion 413, with the radially outer peripheral surface of the conducting wire 422 being internally tangent to the end face of the first lead portion 413 away from the second lead portion 414; or that conducting wire 422 is entirely located within the second lead portion 414, with the radially outer peripheral surface of the conducting wire 422 being internally tangent to the end face of the second lead portion 414 away from the first lead portion 413. The configurations of the conducting wire 422 with respect to the second lead portion 414 and the flange 412 are similar to the aforementioned cases.

It should be understood that the fixed portion of the conducting wires 422 perpendicular to the axial direction of the body 411 is enlarged with the flanges 412. In an embodiment, in order to avoid the difficulty in discharging the smoke after atomization when the heating wire 421 is disposed within the flange 412, the heating wire 421 may be located between the two flanges 412 and the conducting wires 422 may then extend through the flanges 412. In the case that the heating wire 421 is not located within the flanges 412, the conducting wires 422 may extend through the flanges 412 at edges thereof, or may be inclinedly extend through the flanges 412, such that it would be difficult to firmly fix the heating wire 421 in the axial direction of the body 411, or it would be difficult to ensure the uniformity of the conducting wires 422 when the conducting wires 422 inclinedly extend through the flange 412. However, in the embodiment, with the first lead portion 413 and the second lead portion 414, the fixed portion of the conducting wires 422 in the axial direction of the body 411 become larger, and the conducting wires 422 can extend through directly perpendicular to the axial direction of the body 411.

In an embodiment, the heating wire 421 is embedded in the body 411 and internally tangent to the outer peripheral surface of the body 411. In this way, when the heating wire 421 is disposed on the liquid guiding member 41, the heating wire 421 is firmly fixed and would not be subjected to deformation. In addition, the heating wire 421 is located between the first lead portion 413 and the second lead portion 414, so that the smoke formed in the liquid guiding member 41 by heating the liquid via the heating wire 421 can directly overflow the atomizing element 40, so as to shorten the overflow path. A recess 4112 is provided on the outer peripheral surface of the body 411 and extends along the axial direction of the body 411, and at least a portion of the heating wire 421 is exposed in the recess 4112. A radial edge of the heating wire 421 is internally tangent to the body 411, and a portion of the heating wire 421 is exposed from the recess 4112. A portion of the heating wire 421 located within the body 411 is entirely covered by the body 411, so that the heating wire 421 is firmly fixed and supported in the body 411, and the heating wire 421 is effectively prevented from being separated from the body 411.

Compared with the portion of heating wire 421 exposed in the recess 4112, relatively more liquid infiltrates the portion of the heating wire 421 located within the body 411. When the entire heating wire 421 is heated, the atomization temperature of the portion of the heating wire 421 located within the body 411 is lower than that of the portion of the heating wire 421 exposed in the recess 4112 for a certain period of time. The smoke formed from the liquid atomized by the portion of the heating wire 421 located within the body 411 flows from the outer surface of the body 411 to the airflow channel 22. And the smoke formed from the liquid atomized by the portion of the heating wire 421 exposed in the recess 4112 flows from the recess 4112 to the airflow channel 22. These two kinds of smoke taste different as the liquid, such as tobacco liquid, can be atomized at different temperatures, resulting in diversified taste of the smoke formed by the atomizing element 40.

In addition, when the heating wire 421 is heated, the temperature of the portion of the heating wire 421 exposed in the recess 4112 increases more quickly than that of the portion of the heating wire 421 located within the body 411. The portion of the heating wire 421 exposed in the recess 4112 is the first to reach an initial atomization temperature at which the liquid is transformed into smoke, so as to atomize the liquid and thus to form the smoke in a short time. A plurality of recesses 4112 may be provided and arranged separated from one another along the periphery of the body 411.

In the specific application, the conducting wires 422 are welded to both ends of the heating wire 421. The resistance of the heating wire 421 is higher than that of the conducting wires 422 to heat and atomize the liquid. The heating wire 421 is electrically coupled to the power supply assembly 60 through the conducting wires 422. The conducting wires 422 are fixed by a positioning mold after being welded to the heating wire 421, and then the liquid guiding member 41 is molded by injection. The recess 4112 is formed through the mold, and a corresponding portion of the mold is disposed between two turns of the heating wire 421, so as to obtain uniform spacing between each two turns of the heating wire 421. Therefore, in the atomization process, the heat generated by the heating wire 421 can be more uniformly conducted in the liquid guiding member 41 to improve the overall atomization performance. The two conducting wires 422 are electrically coupled to two electrodes of the power supply assembly 60, respectively. Specifically, the two conducting wires 422 extend out of the bottom of the atomizing base 30, and portions of the conducting wires 422 beyond the bottom of the atomizing base 30 is then removed, so as to electrically couple the conducting wires 422 with the two electrodes of the power supply assembly 60.

The body 411 is further provided with a connecting portion 415 extending axially from two ends thereof. The liquid guiding member 41 is provided with an accommodating cavity 417 therein extending axially through the body 411 and the connecting portion 415. The accommodating cavity 417 is in communication with the liquid inlet 31 which is located on an outer side of the atomizing base 30, such that the liquid in the liquid storage chamber 21 can quickly flow into the liquid guiding member 41 through the liquid inlet 31, resulting in an increased liquid guiding speed. The sealing member 50 is located outside the liquid inlet 31 so that the sealing member 50 would not occupy the inner space of the liquid inlet 31 when the sealing member 50 unseals the liquid inlet 31, such that the speed of the liquid flowing into the atomizing element 40 through the liquid inlet 31 is faster, and the amount of the liquid stored in the atomizing element 40 is larger.

In an embodiment, referring to FIGS. 3 and 4, an air-permeable liquid absorbing member 90 is provided between the atomizing base 30 and the atomizing element 40 and is sleeved on the atomizing element 40. Since the air-permeable liquid absorbing member 90 has air permeability, the gas generated in the porous structure of the atomizing element 40 can be discharged into the liquid storage chamber 21 through the air-permeable liquid absorbing member 90. Thus, the fluidity of the gas between the atomizing element 40 and the liquid storage chamber 21 is improved, partial vacuum of the liquid storage chamber 21 after the oil is discharged caused by the gas being not able to enter the liquid storage chamber 21 is avoided, so that the liquid in the liquid storage chamber 21 can continuously flow into the atomizing element 40. In addition, the liquid in the liquid guiding member 41 may overflow from the surface of the liquid guiding member 41 when the liquid is not atomized in time. The air-permeable liquid absorbing member 90 can absorb and lock the liquid overflowing from the surface of the atomizing element 40 to prevent the liquid from flowing out of the atomizing base 30.

Figure 8:
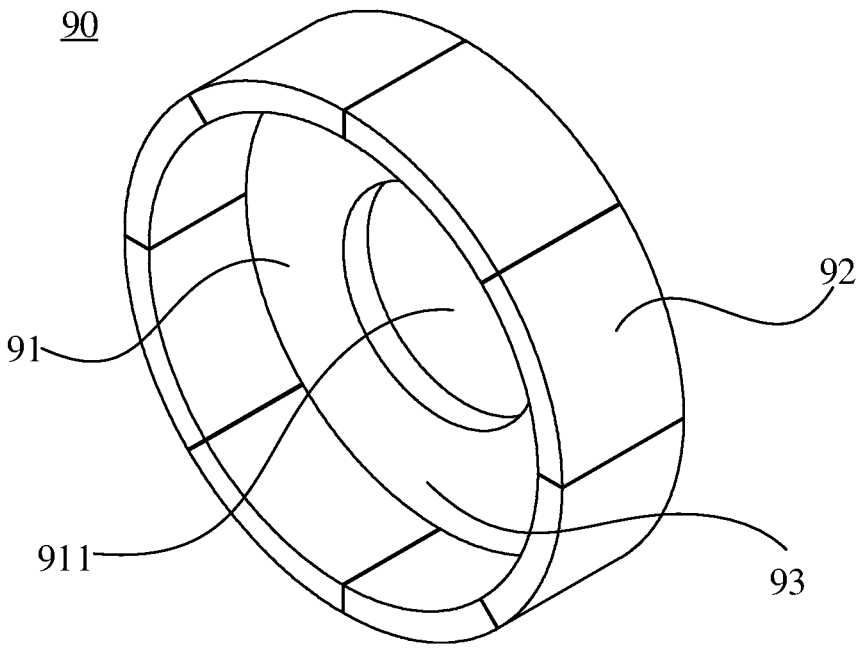
FIG. 8 is a schematic view of an air-permeable liquid absorbing member of the atomizing assembly of FIG. 1.
Figure 9:
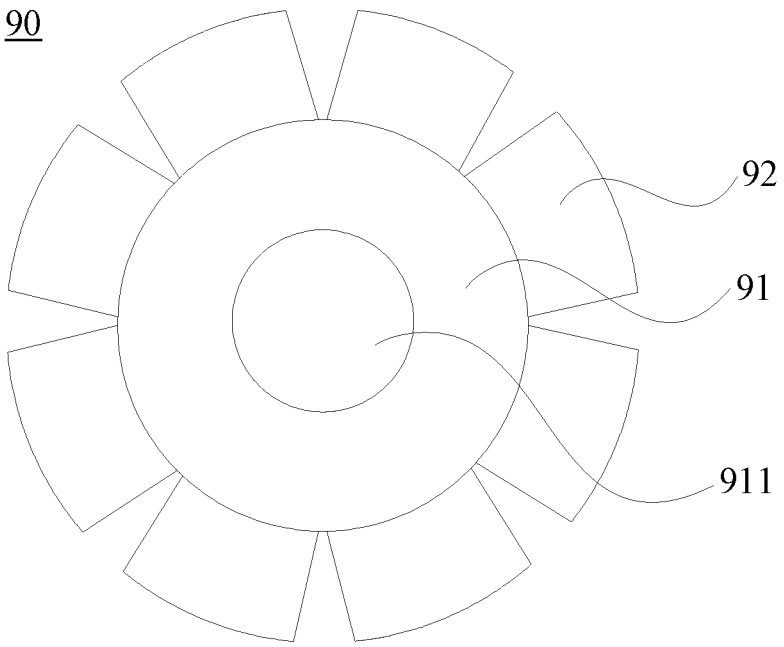
FIG. 9 is a developed view of the air-permeable liquid absorbing member of FIG. 8.

In an embodiment, referring to FIGS. 8 and 9, the air-permeable liquid absorbing member 90 includes a substrate 91 and a plurality of side walls 92 extending from a periphery of the substrate 91. The plurality of side walls 92 and the substrate 91 cooperatively forms a mounting cavity 93, and at least a portion of the atomizing element 40 is received in the mounting cavity 93. The substrate 91 abuts against an end surface of the flange 412, and the plurality of side walls 92 abuts against the outer peripheral surface of the flange 412, such that the air-permeable liquid absorbing member 90 is stably sleeved on the flange 412. The body 411, the flange 412, the connecting portion 415 of the liquid guiding member 41 each may be formed in a cylindrical shape. The substrate 91 may be circular in shape provided with an opening 911 in the middle thereof, and the side walls 92 are disposed along the periphery of the substrate. The plurality of side walls 92 are folded over a same side of the substrate 91 to form the mounting cavity 93. It should be noted that both ends of the atomizing element 40 may be provided with air-permeable liquid absorbing members 90, respectively. When the air-permeable liquid absorbing member 90 is sleeved on the atomizing element 40, the connecting portion 415 extends through the opening 911, with the substrate 91 abutting against the end surface of the flange 412 and the plurality of side walls 92 abutting the outer peripheral surface of the flange 412. The air-permeable liquid absorbing member 90 may be made of cotton or the like.

In an embodiment, for a more stable cooperation of the atomizing base 30 with the other components, the atomizing base 30 may include three portions made of different materials. A first portion of the atomizing base 30 connecting with the atomizing element 40 may be made of silica gel or the like, so as to more tightly connect the atomizing seat 30 with the atomizing element 40 without a fitting clearance which might be generated if a hard material is used. A second portion of the atomizing base 30 connecting to the airflow channel 22 may be made of plastic material or the like. A third portion of the atomizing seat 30 connecting to the housing 20 may be made of plastic material.

Figure 10:
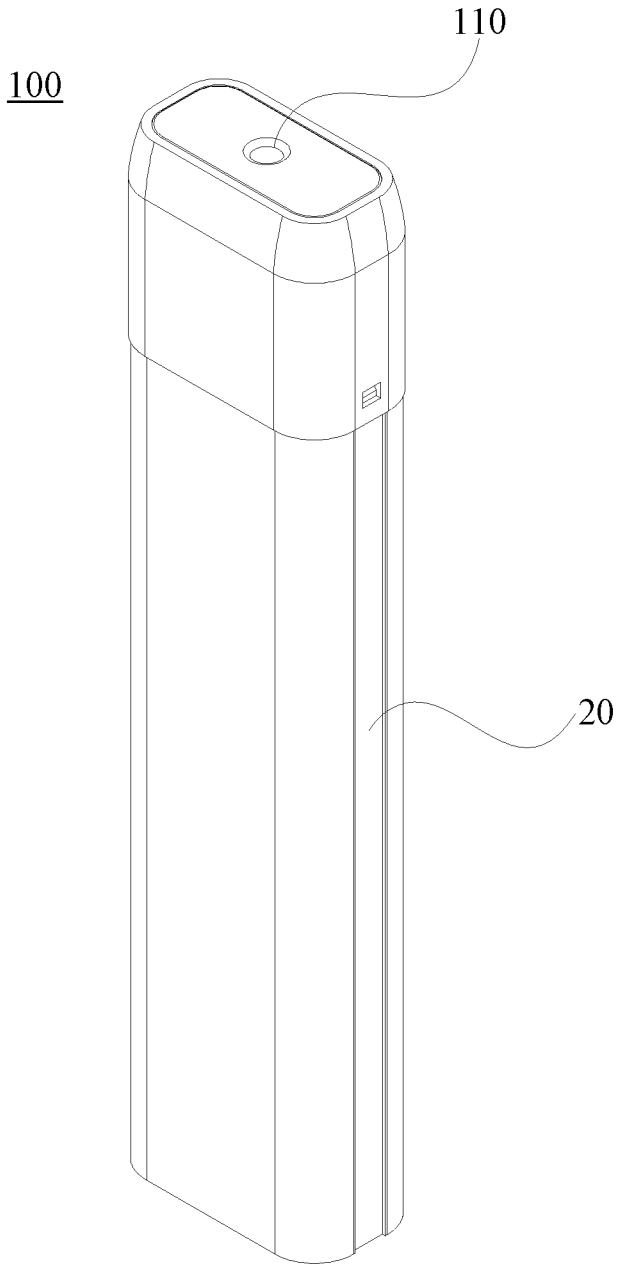
FIG. 10 is a schematic view of an electronic atomizing device according to an embodiment.
Figure 11:
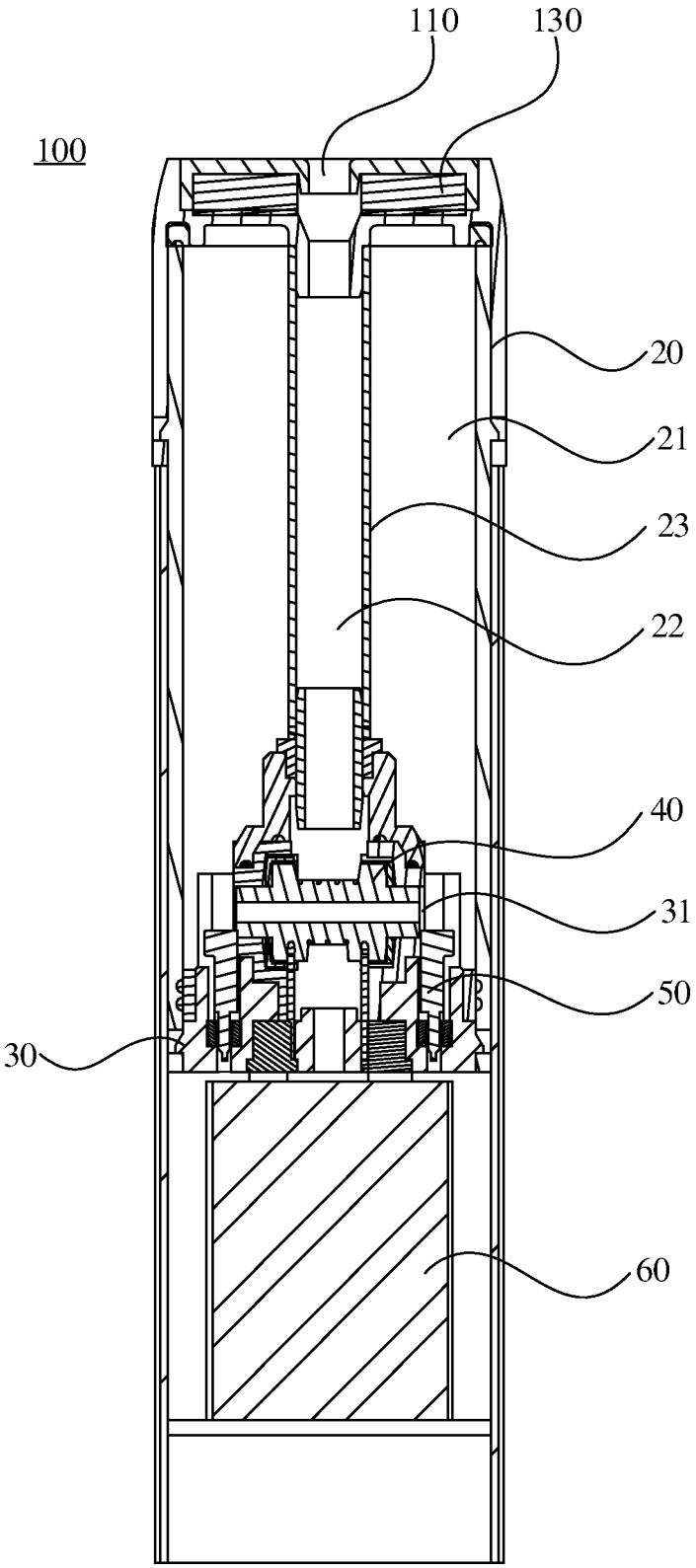
FIG. 11 is a cross-sectional view of the electronic atomizing device of FIG. 10.

In an embodiment, referring to FIGS. 10 and 11, an electronic atomizing device 100 is provided, including the aforementioned atomizing assembly 10 and a power supply assembly 60. The power supply assembly 60 is connected to the housing 20 and electrically coupled to the conducting wires 422. The electronic atomizing device 100 includes the atomizing assembly 10 and the atomizing element 40 described above, thus at least has the above-described advantageous effects, which will not be described here. During storage or transportation of the electronic atomizing device 100 for a long time, liquid leakage due to collision or shock would not occur. In addition, the electronic atomizing device 100 according to the embodiment generates smoke more quickly, the atomization of the liquid is more sufficient, and the electronic atomizing device 100 offers a better taste.

In an embodiment, a suction nozzle 110 is disposed at an end of the housing 20 away from the power supply assembly 60. The breather pipe 23 has one end in communication with the atomizing element 40 and the other end in communication with the suction nozzle 110. An absorbent sheet 130 is further provided between an end of the housing 20 and a side of the suction nozzle 110 proximal to the housing 20. The absorbent sheet 130 is configured to absorb the liquid leaked from the end of the housing 20 to prevent the leaked liquid from being sucked through the suction nozzle 110. In an embodiment, the absorbent sheet 130 may be made of cotton, cloth or the like as long as it can absorb liquid.

Although the respective embodiments have been described one by one, it shall be appreciated that the respective embodiments will not be isolated. Those skilled in the art can apparently appreciate upon reading the disclosure of this application that the respective technical features involved in the respective embodiments can be combined arbitrarily between the respective embodiments as long as they have no collision with each other. Of course, the respective technical features mentioned in the same embodiment can also be combined arbitrarily as long as they have no collision with each other.

Although the disclosure is illustrated and described herein with reference to specific embodiments, the disclosure is not intended to be limited to the details shown. Rather, various modifications may be made in the details within the scope and range of equivalents of the claims and without departing from the disclosure.

What is claimed is:

1. An atomizing assembly, comprising:

a housing including a liquid storage chamber and an airflow channel, the liquid storage chamber being configured to store liquid;

an atomizing base fixed to the housing and configured to seal the liquid storage chamber, the atomizing base including a liquid inlet in communication with the liquid storage chamber;

an atomizing element disposed in the atomizing base and configured to atomize the liquid flowing into the atomizing element through the liquid inlet; and a sealing member movably disposed on the atomizing base and configured to seal or unseal the liquid inlet;

wherein the atomizing base is provided with a sliding slot, the liquid inlet is located at a bottom of the sliding slot, and the sealing member is slidably disposed within the sliding slot to seal or unseal the liquid inlet.

2. The atomizing assembly according to claim 1, wherein the sealing member comprises:

a pull rod disposed through the atomizing base; and a sealing portion located in the sliding slot, wherein the pull rod has a first end connected to the sealing portion and a second end extending out of the atomizing base, and the pull rod is movable towards or away from the liquid inlet, such that the sealing portion is slidable within the sliding slot to seal or unseal the liquid inlet.

3. The atomizing assembly according to claim 2, wherein the sealing portion includes a limiting portion protruding from a side of the sealing portion away from the liquid inlet, and the pull rod is limited by the limiting portion abutting against the atomizing base when the pull rod moves away from the liquid inlet.

4. The atomizing assembly according to claim 2, wherein the pull rod includes a breakage portion having a cross-sectional area less than that of other portions of the pull rod.

5. The atomizing assembly according to claim 2, further comprising an elastic sealing member, wherein the atomizing base includes a sliding channel in communication with the sliding slot, the elastic sealing member is latched with the sliding channel, the pull rod is disposed through the elastic sealing member and is movable within the sliding channel towards or away from the liquid inlet.

6. The atomizing assembly according to claim 2, further comprising a pull tab fixedly sleeved on the second end of the pull rod.

7. The atomizing assembly according to claim 1, further comprising an air-permeable liquid absorbing member disposed between the atomizing base and the atomizing element and sleeved on the atomizing element.

8. The atomizing assembly according to claim 7, wherein the air-permeable liquid absorbing member comprises a substrate and a plurality of side walls extending from a periphery of the substrate, the plurality of side walls and the substrate cooperatively forms a mounting cavity, and at least a portion of the atomizing element is received in the mounting cavity.

9. The atomizing assembly according to claim 8, wherein the atomizing element comprises a body and a flange sleeved on an outer peripheral surface of the body, the substrate abuts against an end surface of the flange, and the plurality of side walls abut against an outer peripheral surface of the flange.

10. The atomizing assembly according to claim 9, wherein the body includes a connecting portion extending axially from an end of the body, the atomizing element is provided with an accommodating cavity therein extending axially through the body and the connecting portion, the substrate is provided with an opening in communication with the mounting cavity, and the connecting portion extends through the opening.

11. The atomizing assembly according to claim 1, wherein the atomizing element comprises a liquid guiding member configured to absorb the liquid flowing through the liquid inlet and a heating element configured to heat the liquid.

12. The atomizing assembly according to claim 11, wherein the liquid guiding member comprises a body and two flanges located on both ends of the body, the heating element is disposed on the body and has two ends extending out of the flanges, respectively.

13. The atomizing assembly according to claim 12, wherein the heating element comprises a heating wire wound around and bonded to the body.

14. The atomizing assembly according to claim 13, wherein the heating wire is embedded in the body and internally tangent to an outer peripheral surface of the body.

15. The atomizing assembly according to claim 13, wherein the body includes a recess on an outer peripheral surface of the body, the recess extends along an axial direction of the body, and at least a portion of the heating wire is exposed in the recess.

16. The atomizing assembly according to claim 13, wherein the heating element further comprises conducting wires connecting to both ends of the heating wire and extending through the flanges.

17. The atomizing assembly according to claim 16, wherein a first lead portion and a second lead portion are formed at opposite ends of the two flanges, respectively, and the conducting wires extend through junctions of the first lead portion and the second lead portion with the corresponding flanges.

18. An electronic atomizing device, comprising an atomizing assembly;

wherein the atomizing assembly comprises:

a housing including a liquid storage chamber and an airflow channel, the liquid storage chamber being configured to store liquid;

an atomizing base fixed to the housing and configured to seal the liquid storage chamber, the atomizing base including a liquid inlet in communication with the liquid storage chamber;

an atomizing element disposed in the atomizing base and configured to atomize the liquid flowing into the atomizing element through the liquid inlet; and a sealing member movably disposed on the atomizing base and configured to seal or unseal the liquid inlet;

wherein the atomizing base is provided with a sliding slot, the liquid inlet is located at a bottom of the sliding slot, and the sealing member is slidably disposed within the sliding slot to seal or unseal the liquid inlet; and a power supply assembly connected to the housing and electrically coupled to the atomizing element.

* * * * *